US011535415B2

(12) United States Patent
Garfield et al.

(10) Patent No.: US 11,535,415 B2
(45) Date of Patent: Dec. 27, 2022

(54) COMPRESSIBLE AND EXPANDABLE BOTTLE

(71) Applicant: Berlin Packaging, LLC, Chicago, IL (US)

(72) Inventors: Alexander Nathan Garfield, Chicago, IL (US); Katrina Marie Epperson, Chicago, IL (US); Nora Kathleen Flood, Chicago, IL (US)

(73) Assignee: Berlin Packaging, LLC, Chicago, IL (US)

( * ) Notice: Subject to any disclaimer, the term of this patent is extended or adjusted under 35 U.S.C. 154(b) by 45 days.

(21) Appl. No.: 17/203,082

(22) Filed: Mar. 16, 2021

(65) Prior Publication Data

US 2022/0297871 A1 Sep. 22, 2022

(51) Int. Cl.

| | |
|---|---|
| ***B65D 1/02*** | (2006.01) |
| ***B65D 1/40*** | (2006.01) |
| ***A45F 3/20*** | (2006.01) |
| ***B65D 21/08*** | (2006.01) |

(52) U.S. Cl.

CPC ..... *B65D 1/0292* (2013.01); *A45F 3/20* (2013.01); *B65D 1/40* (2013.01); *B65D 21/086* (2013.01); *B65D 2501/0081* (2013.01)

(58) Field of Classification Search

CPC ..... B65D 1/0292; B65D 2501/0081; B65D 1/40; B65D 21/086; A45F 3/20

See application file for complete search history.

(56) References Cited

U.S. PATENT DOCUMENTS

| | | | |
|---|---|---|---|
| 2,899,110 | A | 8/1959 | Parker |
| 3,220,544 | A | 11/1965 | Lovell |
| 3,301,293 | A | 1/1967 | Santelli |
| 3,872,994 | A | 3/1975 | Hyde |
| 3,918,603 | A | 11/1975 | Hatada |
| 3,921,897 | A | 11/1975 | Noyes |

(Continued)

FOREIGN PATENT DOCUMENTS

| | | |
|---|---|---|
| EP | 1790573 | 5/2007 |
| WO | 199415846 | 7/1994 |

(Continued)

OTHER PUBLICATIONS

The Dieline Package Design Awards 2013: Sustainable Packaging Award—Sustainable Expandable Bowl” thedieline.com (Jun. 23, 2013).

(Continued)

*Primary Examiner* — Don M Anderson
*Assistant Examiner* — Jennifer Castriotta
(74) *Attorney, Agent, or Firm* — Adam K. Sacharoff; Much Shelist, P.C.

(57) ABSTRACT

In an embodiment of the invention, there is shown a bottle having a plurality of shoulder faceted sections and a plurality of bottom faceted section positioned into the shoulder and lower well of the bottle respectively. A triangulated cylinder is formed into the bottle by having pairs of obtuse triangles with a shared side of the triangles located opposite their obtuse angles forming polygons around the triangulated cylinder and in a number of rows between the shoulder and lower well of the bottle. The body of the bottle is made of a material configured to allow the bottle to be compressible and expandable.

16 Claims, 5 Drawing Sheets

(56) References Cited

U.S. PATENT DOCUMENTS

| | | | | |
|---|---|---|---|---|
| 3,946,903 | A | 3/1976 | Parker | |
| 4,125,130 | A * | 11/1978 | Yamamoto | F16L 11/00 138/121 |
| 4,260,099 | A | 4/1981 | Mode | |
| 4,773,458 | A | 9/1988 | Touzani | |
| 4,790,361 | A | 12/1988 | Jones | |
| 4,873,100 | A | 10/1989 | Dirksing | |
| 4,978,021 | A | 12/1990 | Mini | |
| 5,201,438 | A | 4/1993 | Norwood | |
| 5,209,372 | A | 5/1993 | Norwood | |
| 5,226,551 | A | 7/1993 | Robbins | |
| 5,244,125 | A | 9/1993 | Robbins | |
| 5,524,789 | A | 6/1996 | Jackman | |
| 5,549,196 | A * | 8/1996 | Kassman | B65D 1/0292 206/69 |
| 5,573,129 | A | 11/1996 | Nagata | |
| 5,609,899 | A | 3/1997 | Spector | |
| 5,642,826 | A | 7/1997 | Melrose | |
| 5,731,021 | A | 3/1998 | Sperctor | |
| 5,762,262 | A | 6/1998 | Martin | |
| 6,598,755 | B1 | 7/2003 | Pedulla | |
| RE38,770 | E | 8/2005 | Gilbert | |
| D510,035 | S | 9/2005 | Higuchi | |
| 7,717,282 | B2 | 5/2010 | Melrose | |
| 7,802,691 | B2 | 9/2010 | Mu | |
| 7,819,263 | B1 | 10/2010 | Dicarlo-nelson | |
| 7,866,500 | B1 | 1/2011 | Peggs | |
| 8,091,741 | B2 | 1/2012 | Pritchard | |
| D695,607 | S | 12/2013 | Karvalis | |
| 8,777,825 | B1 * | 7/2014 | Kling | B65D 5/2038 493/162 |
| 8,844,743 | B2 | 9/2014 | Costa | |
| 9,211,975 | B2 | 12/2015 | Robbins | |
| 9,266,133 | B2 | 2/2016 | Fyke | |
| 9,290,296 | B2 | 3/2016 | Tom | |
| 9,296,508 | B2 | 3/2016 | Kanfer | |
| 9,301,902 | B2 | 4/2016 | Epars | |
| 9,650,197 | B1 | 5/2017 | Efstathiou | |
| 9,688,427 | B2 | 6/2017 | Melrose | |
| 9,840,405 | B2 | 12/2017 | Giuffrida | |
| 10,081,481 | B2 | 9/2018 | Fernandez | |
| 10,155,327 | B2 | 12/2018 | Amsellem | |
| 10,427,824 | B2 | 10/2019 | Matsunami | |
| 10,433,632 | B2 | 10/2019 | Resic | |
| D867,147 | S | 11/2019 | Liu | |
| 11,111,069 | B1 * | 9/2021 | Zung | B65D 1/40 |
| 2006/0118509 | A1 | 6/2006 | Nottingham | |
| 2009/0057321 | A1 | 3/2009 | Hong | |
| 2009/0159603 | A1 | 6/2009 | Lilco | |
| 2009/0285949 | A1 | 11/2009 | Brown | |
| 2010/0072167 | A1 | 3/2010 | Dickie | |
| 2010/0108698 | A1 | 5/2010 | Daliri | |
| 2010/0140294 | A1 | 6/2010 | Bourguignon | |
| 2010/0314284 | A1 | 12/2010 | Truesdale | |
| 2011/0165298 | A1 | 7/2011 | Hong | |
| 2012/0152885 | A1 | 6/2012 | Munoz | |
| 2015/0034661 | A1 | 2/2015 | Cooper | |
| 2016/0130026 | A1 | 5/2016 | Brown | |
| 2019/0185210 | A1 | 6/2019 | Demarest | |
| 2020/0231324 | A1 | 7/2020 | Swarts | |
| 2020/0305619 | A1 | 10/2020 | Tsui | |
| 2021/0245913 | A1 * | 8/2021 | Obana | B65D 83/0055 |

FOREIGN PATENT DOCUMENTS

| | | |
|---|---|---|
| WO | 199956454 | 12/1999 |
| WO | 200043276 | 7/2000 |
| WO | 200224531 | 3/2002 |
| WO | 200247988 | 6/2002 |
| WO | 2008017823 | 2/2008 |
| WO | 2008022605 | 2/2008 |
| WO | 2011055152 | 5/2011 |
| WO | 2017089851 | 10/2017 |
| WO | 2019118332 | 6/2019 |
| WO | 2019233618 | 12/2019 |
| WO | 2020174425 | 9/2020 |
| WO | 2020174466 | 9/2020 |

OTHER PUBLICATIONS

Tri-Tainer (Concept)” packagingoftheworld.com (Oct. 13, 2011).

Colgate Redesign” nnuzzo.com (Mar. 14, 2014).

Tang, Tea and More, On the Go” yankodesign.com (Apr. 5, 2010).

* cited by examiner

COMPRESSIBLE AND EXPANDABLE BOTTLE

FIELD OF THE INVENTION

The present invention relates to a bottle and more particularly to a bottle designed to compress for sale to a consumer and then expand to its full size for use by the consumer.

BACKGROUND OF THE INVENTION

Bottles can be used and sold in a variety of ways, such as for the initial transportation and sale to a store and then once purchased by the consumer. Bottles are mostly sold in a full expanded state and thus take up organizational space and increase transportation costs. In addition, some bottles over the years have been designed to be sold in a compressible state, but these also do not provide full benefits to the consumer. As most of the compressible bottles are simply accordion type bottles that the user must expand on their own. There is a need in the art for a compressible and expandable bottle that relies less on the consumer expanding the bottle and more that has a tendency to be in an expanded state. Specifically, there is a need for a bottle designed to be compressible but have a tendency to want to be in an expanded state such that when packaging the compressed bottle, it needs to be held in the compressed state.

One benefit of these types of bottles is the ability for the manufacturer to sale compressed bottles with additives packets, that may contain flavorings, coloring, vitamins, minerals, or a combination thereof and in either liquid or powder form. The bottle after purchasing and after unwrapping expands to provide the consumer with the ability to add water.

SUMMARY OF THE INVENTION

In one embodiment of the present invention there is provided a bottle having a neck with an opening for access into an internal volume of the bottle, the bottle further having a shoulder section terminating to a body which extends downwardly to a lower well and bottom. The bottle further having (a) a plurality of shoulder faceted sections and a plurality of bottom faceted section defined into the shoulder and lower well of the bottle respectively; (b) a triangulated cylinder formed into the body of the bottle, the triangulated cylinder being defined by having pairs of obtuse triangles with a shared side of the triangles located opposite their obtuse angles and forming polygons around the triangulated cylinder and in a number of rows between the shoulder and lower well of the bottle; and (c) the triangulated cylinder of the bottle being compressible and expandable to configure the bottle into a compressed configuration and an expanded configuration, and wherein the bottle being made from a material that when in a compressed configuration the material about each side of the triangles opposite their respective obtuse angles is placed in tension and configured to cause the triangulated cylinder to return to the expanded configuration. In addition, wrapping material may be provided around the bottle in the compressed configuration to prevent the bottle from returning to the expanded configuration. The wrapping material has a frangible removable section to allow the user to unwrap the bottle.

In aspects of the invention the plurality of shoulder faceted sections and the bottom faceted sections equals eight. And the plurality of rows equals four.

In other aspects of the invention the triangulated cylinder in the expanded configuration has an expanded height that is six times higher than a compressed height of the triangulated cylinder in the compressed configuration; while the total height of the bottle in the expanded configuration is about three times higher than the bottle in the compressed configuration.

In yet other aspects of the invention the triangulated cylinder is further defined by having the polygons displace around the triangulated cylinder from one row to the row there below, such that a column of polygons are displaced at a predefined rotational angle between rows, wherein the column of polygons starting under a first shoulder faceted section is displaced to end over a different bottom faceted section. In aspects of this invention the displacement of the column of polygons is over two faceted sections.

With the ability of packaging bottles in a compressed configuration, a liquid or powder additive can be included into the compressed configuration of the bottle, allowing the consumer to unwrap and expand the bottle to add water to the additive.

In another aspect of the invention there is provided a compressible and expandable bottle with packaging that would be defined to include: a bottle having a neck with an opening for access into an internal volume of the bottle, the bottle further having a shoulder section terminating to a body which extends downwardly to a lower well; bottom and a plurality of shoulder faceted sections and a plurality of bottom faceted section defined into the shoulder and lower well of the bottle respectively; and a triangulated cylinder formed into the body of the bottle, the triangulated cylinder being defined by having pairs of obtuse triangles with a shared side of the triangles located opposite their obtuse angles and forming polygons around the triangulated cylinder and in a number of rows between the shoulder and lower well of the bottle; and the triangulated cylinder of the bottle being compressible and expandable to configure the bottle into a compressed configuration and an expanded configuration, and wherein the bottle being made from a material that when in a compressed configuration the material about each side of the triangles opposite their respective obtuse angles is placed in tension and configured to cause the triangulated cylinder to return to the expanded configuration. The combination would further include a liquid or powder additive included into the compressed configuration for packaging and wrapping material around the bottle in the compressed configuration to prevent the bottle from returning to the expanded configuration, and the wrapping material having a frangible removable section.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
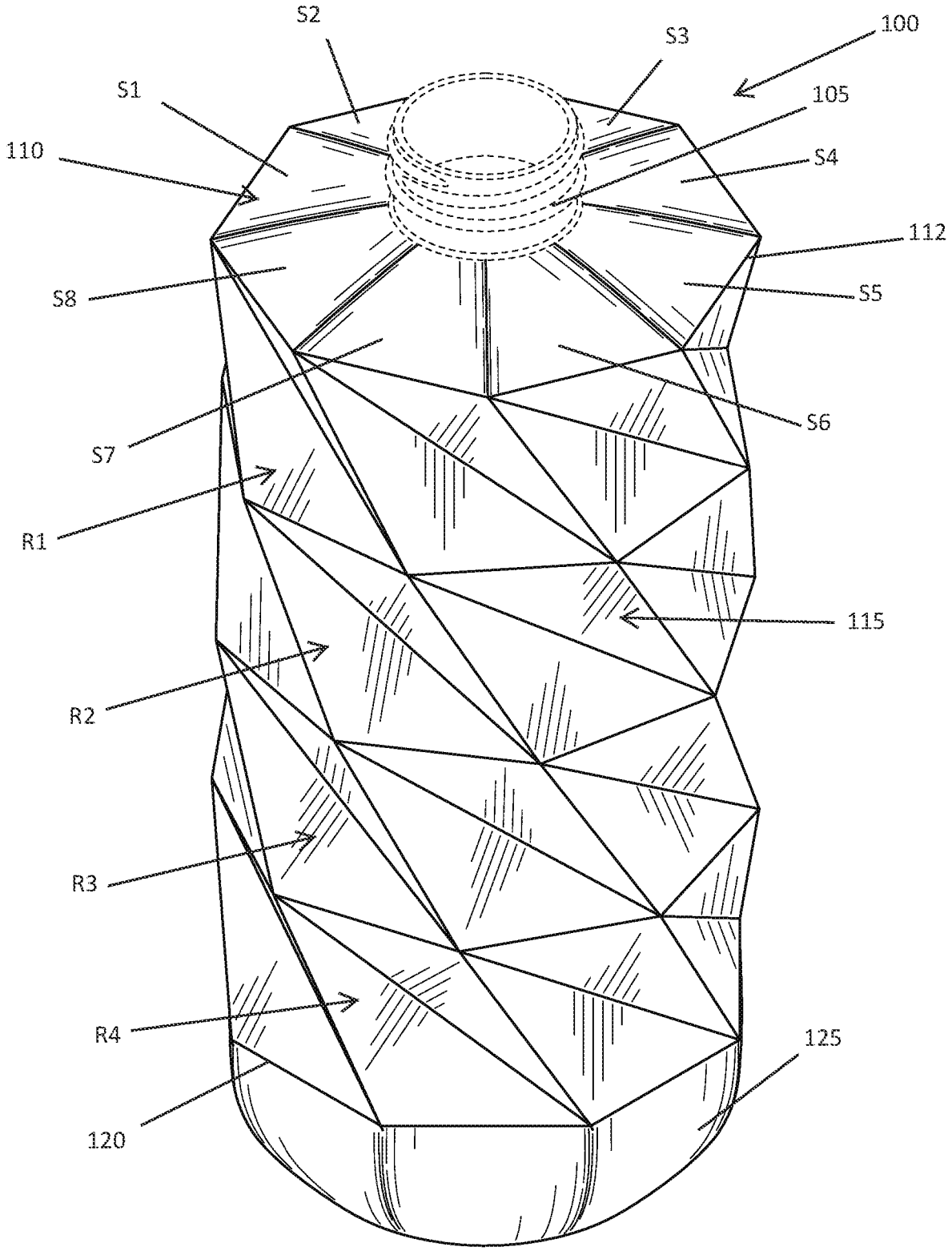
FIG. 1 is a perspective view of the bottle in an expanded configuration.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention of the embodiments illustrated.

Referring now to FIGS. 1 through 5 there is provided a compressible and expandable bottle 100 for use by a consumer. The bottle 100 is patterned in a triangulated cylinder, which is known in the art but not for use as consumable bottles. The bottle 100 includes an opened neck 105 terminated into a shoulder section 110 that is defined as eight faceted sections (S1 through S8), each of which terminate along an edge 112 into the sides of the cylinder. The sides include rows (R1 through R4) of polygons 115. The number of polygons per row will match the number of faceted sections. Each polygon 115 is made up of a pair of triangles (T1 and T2). In the current embodiment, each triangle has angles A, B, C, wherein angle A is about 29°, angle B is about 114°, and angle C is about 37°. The last row R4 of polygons includes a bottom terminal edge 120 that forms into a lower well 125 and which includes a bottom 130.

The bottle 100 which can be compressed and expanded has a tendency to return to the expanded state. This is caused because when the bottle is compressed, the long sides of the triangles are put into tension, so the sides naturally want to relax back to their default, expanded state once the wrap is removed. Thus, in order to package and sell the bottle to the consumer, the bottle must be maintained in its compressed position. As such, one important aspect of the invention is to package the bottle 100 with a wrap 150 that extends over the shoulder, sides, and bottom of the bottle. The wrap 150 can be shrink wrap 155 with a frangible portion 160 that allows the consumer to easily remove. Other wrappings can be employed such as a clip that slips on over the compressed bottle.

Another embodiment of the invention is that the manufacturer can sell the compressed bottle 110 with an additive packet 175, that may contain flavorings, coloring, vitamins, minerals, or a combination thereof and in either liquid or powder form. Packaged and sold to the consumer, the consumer would then unwrap, expand and add water to the expanded bottle for their full enjoyment of the purchased product.

In another embodiment of the invention the compressed bottle has a total height of about ⅓ of the total height of the expanded bottle. However, the side section of the bottle expands to about 6 times of its compressed state.

Figure 2:
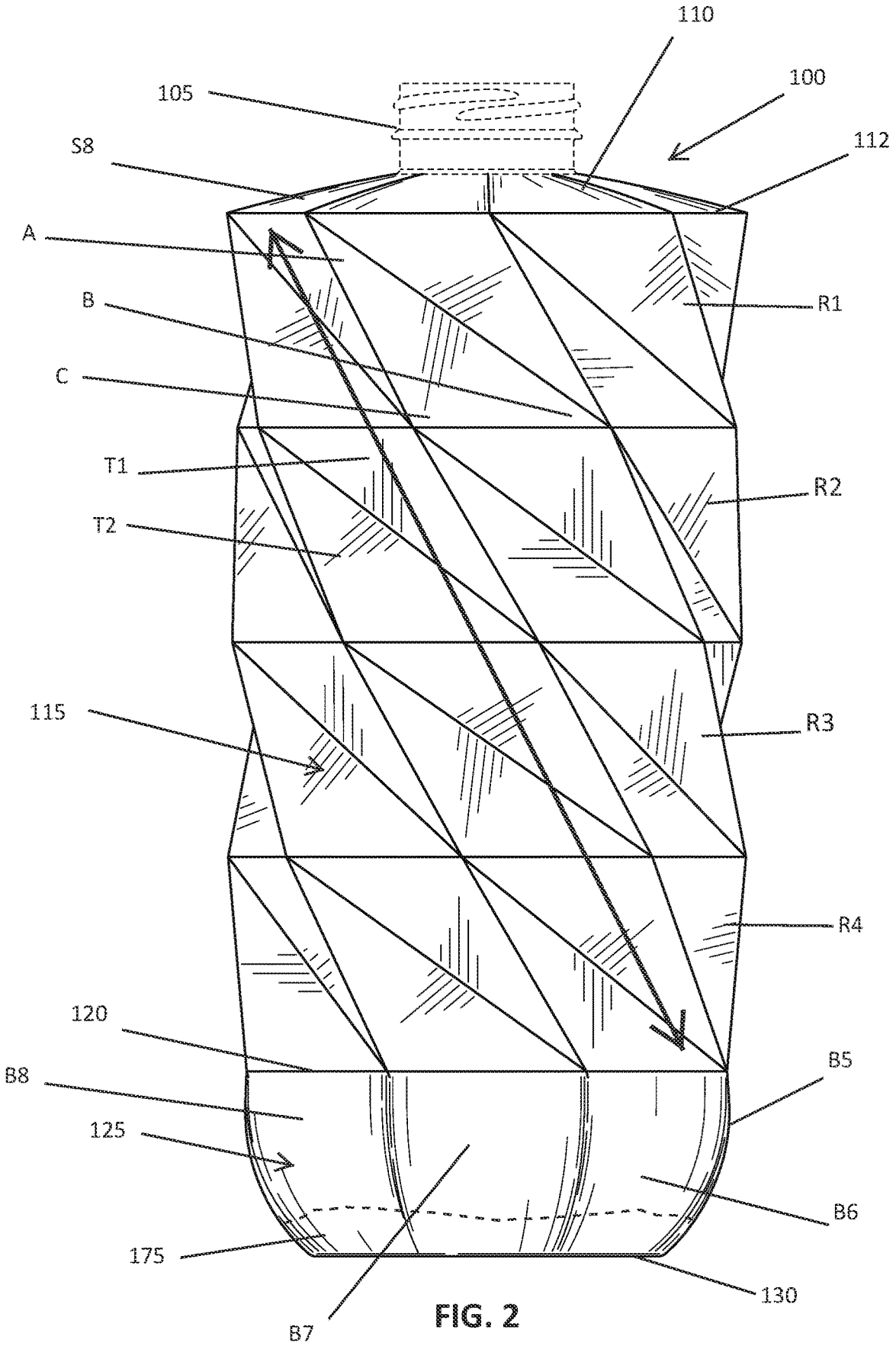
FIG. 2 is a side view of the bottle in an expanded configuration.
Figure 3:
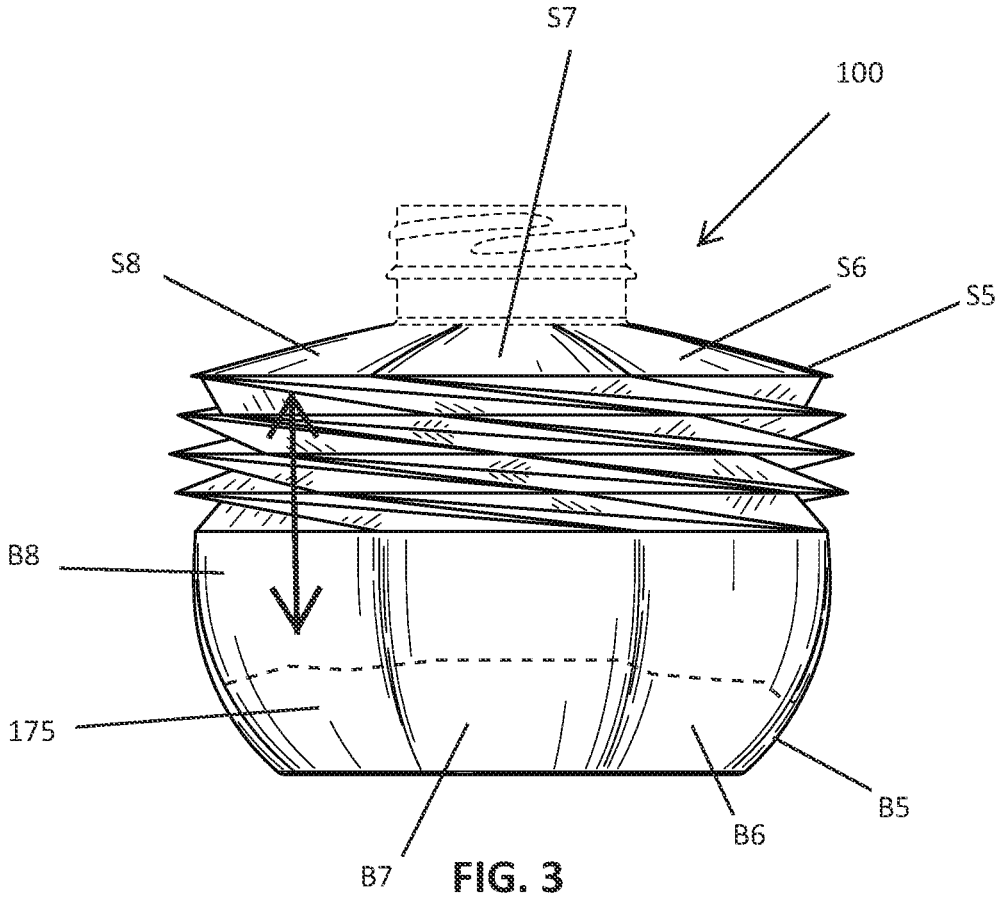
FIG. 3 is a side view of the bottle in a compressed configuration.
Figure 4:
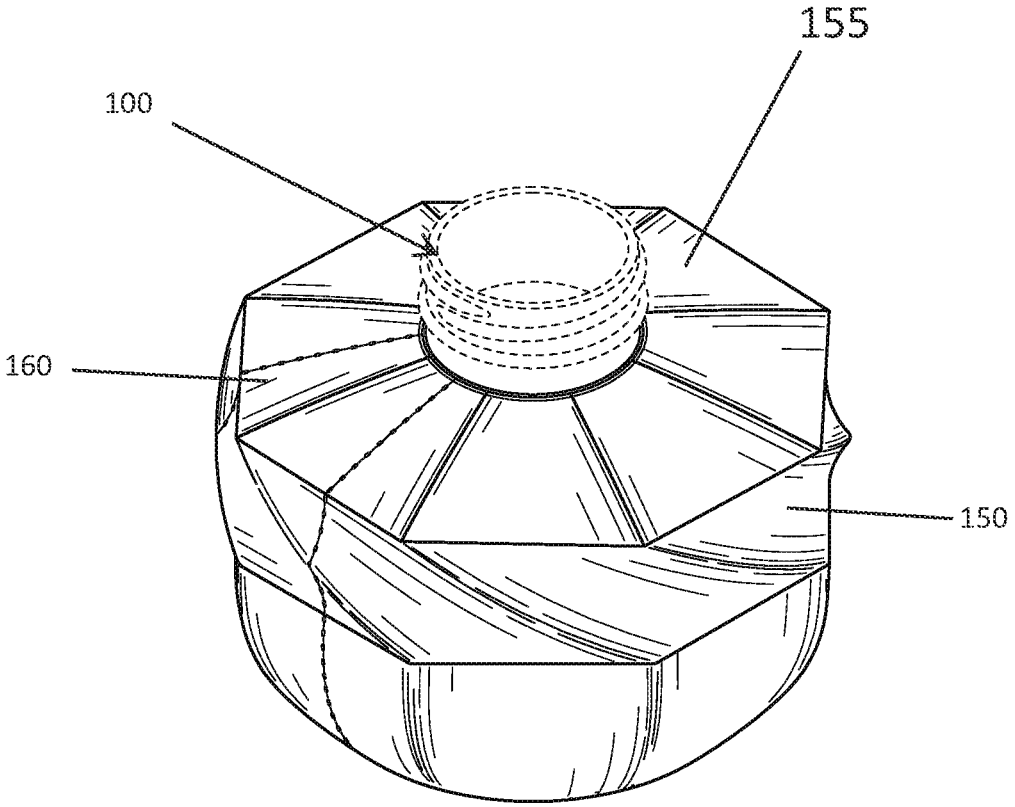
FIG. 4 is a perspective view of the bottle with wrap holding the bottle in a compressed configuration.
Figure 5:
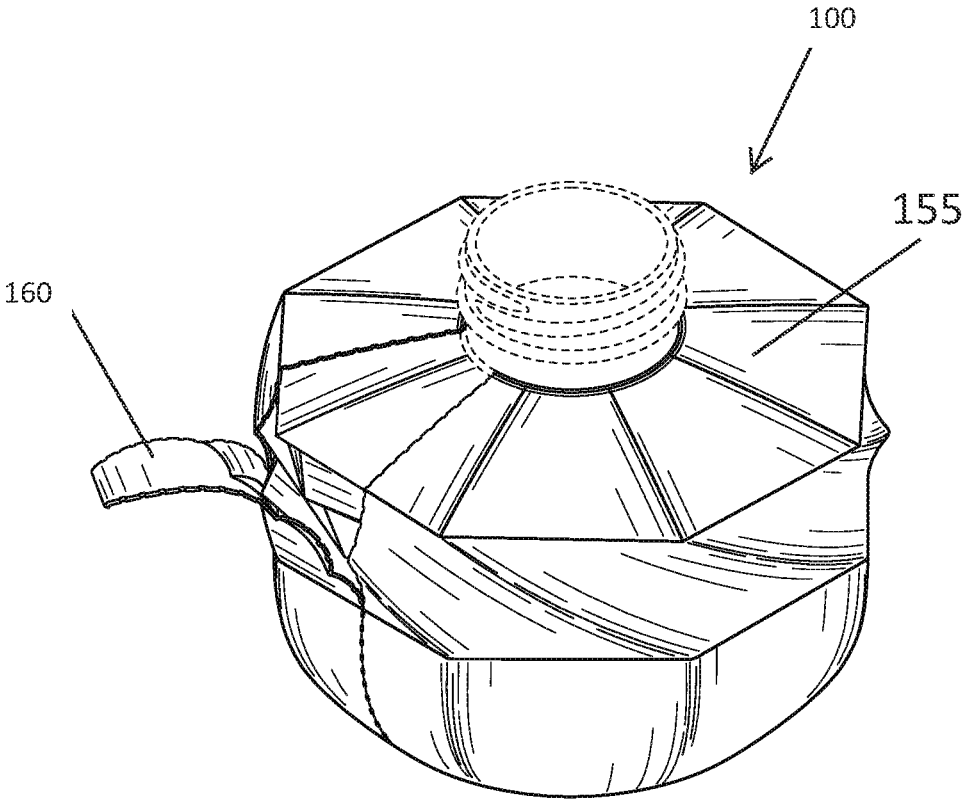
FIG. 5 is a perspective view of the bottle showing partial removal of the wrap.

In addition, when viewed from the side of the bottle, the faceted sections from the shoulder section S* and the lower well B* would visually align (FIG. 3), however, when expanded and visually aligned it is shown that the polygons displace or rotate between layers themselves such that the polygon directed below faceted section S8 displaces at a rotational angle of about 17° between rows, wherein the polygons are displaced over two faceted sections, ending in B6, shown in FIG. 2.

From the foregoing and as mentioned above, it is observed that numerous variations and modifications may be affected without departing from the spirit and scope of the novel concept of the invention. It is to be understood that no limitation with respect to the embodiments illustrated herein is intended or should be inferred. It is intended to cover, by the appended drawings provided, all such modifications within the scope of the invention.

We claim:

1. A bottle having a neck with an opening for access into an internal volume of the bottle, the bottle further having a shoulder section terminating at a body which extends downwardly to a lower well and bottom; the bottle further comprising:

a plurality of shoulder faceted sections and a plurality of bottom faceted sections defined into the shoulder and lower well of the bottle respectively;

a triangulated cylinder formed into the body of the bottle, the triangulated cylinder being defined by having pairs of obtuse triangles with a shared side of the triangles located opposite their respective obtuse angles and forming polygons around the triangulated cylinder and in a number of rows between the shoulder and lower well of the bottle;

the triangulated cylinder of the bottle being compressible and expandable to configure the bottle into a compressed configuration and an expanded configuration, and wherein the bottle is made from a material such that when in a compressed configuration the material about each shared side of the triangles opposite their obtuse angles is placed in tension and configured to cause the triangulated cylinder to return to the expanded configuration; and wherein the triangulated cylinder in the expanded configuration has an expanded height that is six times higher than a compressed height of the triangulated cylinder in the compressed configuration, and wherein the triangulated cylinder further is defined by having the polygons displace around the triangulated cylinder from one row to the row there below, such that a column of polygons is displaced at a predefined rotational angle between rows, wherein the column of polygons starting under a first shoulder faceted section is displaced to end over a different bottom faceted section.

2. The bottle of claim 1 further comprising:

wrapping material around the bottle in the compressed configuration to prevent the bottle from returning to the expanded configuration, and the wrapping material having a frangible removable section.

3. The bottle of claim 2, wherein the plurality of shoulder faceted sections and the bottom faceted sections equals eight.

4. The bottle of claim 3, wherein the plurality of rows equals four.

5. The bottle of claim 4, wherein the total height of the bottle in the expanded configuration is about three times higher than the bottle in the compressed configuration.

6. The bottle of claim 1, wherein the predefined rotational angle displaces the column of polygons over two faceted sections.

7. The bottle of claim 2 further comprising a liquid or powder additive included into the compressed configuration for packaging.

8. A compressible and expandable bottle with packaging comprising:

a bottle having:

a neck with an opening for access into an internal volume of the bottle, the bottle further having a shoulder section terminating at a body which extends downwardly to a lower well and bottom;

a plurality of shoulder faceted sections and a plurality of bottom faceted sections defined into the shoulder and lower well of the bottle respectively;

a triangulated cylinder formed into the body of the bottle, the triangulated cylinder being defined by having pairs of obtuse triangles with a shared side of the triangles located opposite their respective obtuse angles and forming polygons around the triangulated cylinder and in a number of rows between the shoulder and lower well of the bottle; and the triangulated cylinder of the bottle being compressible and expandable to configure the bottle into a compressed configuration and an expanded configuration, and wherein the bottle is made from a material such that when in a compressed configuration the material about each shared side of the triangles opposite their obtuse angles is placed in tension and configured to cause the triangulated cylinder to return to the expanded configuration;

a liquid or powder additive included into the compressed configuration for packaging;

wrapping material around the bottle in the compressed configuration to prevent the bottle from returning to the expanded configuration, and the wrapping material having a frangible removable section; and wherein the triangulated cylinder further is defined by having the polygons displace around the triangulated cylinder from one row to the row there below, such that a column of polygons is displaced at a predefined rotational angle between rows, wherein the column of polygons starting under a first shoulder faceted section is displaced to end over a different bottom faceted section.

9. The compressible and expandable bottle with packaging of claim 8, wherein the plurality of shoulder faceted sections and the bottom faceted sections equals eight and wherein the plurality of rows equals four.

10. The compressible and expandable bottle with packaging of claim 9, wherein the triangulated cylinder in the expanded configuration has an expanded height that is six times higher than a compressed height of the triangulated cylinder in the compressed configuration.

11. The compressible and expandable bottle with packaging of claim 10, wherein the total height of the bottle in the expanded configuration is about three times higher than the bottle in the compressed configuration.

12. A bottle having a neck with an opening for access into an internal volume of the bottle, the bottle further having a shoulder section terminating at a body which extends downwardly to a lower well and bottom; the bottle further comprising:

a plurality of shoulder faceted sections and a plurality of bottom faceted sections defined into the shoulder and lower well of the bottle respectively;

a triangulated cylinder formed into the body of the bottle, the triangulated cylinder being defined by having pairs of obtuse triangles with a shared side of the triangles located opposite their respective obtuse angles and forming polygons around the triangulated cylinder and in a number of rows between the shoulder and lower well of the bottle;

the triangulated cylinder of the bottle being compressible and expandable to configure the bottle into a compressed configuration and an expanded configuration, and wherein the bottle is made from a material such that when in a compressed configuration the material about each shared side of the triangles opposite their obtuse angles is placed in tension and configured to cause the triangulated cylinder to return to the expanded configuration; and wrapping material positioned around the shoulder section of the bottle and the bottom of the bottle and configured to maintain the bottle in the compressed configuration preventing the bottle from returning to the expanded configuration, and the wrapping material having a frangible removable section such that when the wrapping material is removed from the bottle the material of the bottle tends to expand the bottle from the compressed configuration to the expanded configuration and, wherein the triangulated cylinder further is defined by having the polygons displace around the triangulated cylinder from one row to the row there below, such that a column of polygons is displaced at a predefined rotational angle between rows, and wherein the column of polygons starting under a first shoulder faceted section is displaced to end over a different bottom faceted section.

13. The bottle of claim 12, wherein the triangulated cylinder in the expanded configuration has an expanded height that is six times higher than a compressed height of the triangulated cylinder in the compressed configuration.

14. The bottle of claim 12, wherein the plurality of shoulder faceted sections and the bottom faceted sections equals eight.

15. The bottle of claim 14, wherein the plurality of rows equals four.

16. The bottle of claim 15, wherein the total height of the bottle in the expanded configuration is about three times higher than the bottle in the compressed configuration.

* * * * *